11/28/78 XR 4,127,749

United States Patent [19]

Atoji et al.

[11] 4,127,749

[45] Nov. 28, 1978

[54] MICROPHONE CAPABLE OF CANCELLING MECHANICAL GENERATED NOISE

[75] Inventors: Nobuhisa Atoji; Hiroyuki Naono; Hiroshi Yamamoto; Satoru Ibaraki, all of Kadoma, Japan

[73] Assignee: Matsushita Electric Industrial Co., Ltd., Japan

[21] Appl. No.: 783,385

[22] Filed: Mar. 31, 1977

[30] Foreign Application Priority Data

Sep. 9, 1976 [JP] Japan ..... 51-108608

[51] Int. Cl.[2] ..... H04R 17/02

[52] U.S. Cl. ..... 179/110 A; 179/121 D; 310/800

[58] Field of Search ..... 179/110 A, 121 D, 1 DM; 310/367, 800

[56] References Cited

U.S. PATENT DOCUMENTS

| | | | |
|---|---|---|---|
| 2,126,438 | 8/1938 | Williams | 179/110 A |
| 3,181,016 | 4/1965 | Rosenman | 179/110 A |
| 4,008,408 | 2/1977 | Kodama | 179/110 A |
| 4,056,742 | 11/1977 | Tibbetts | 310/800 |

FOREIGN PATENT DOCUMENTS

| | | | |
|---|---|---|---|
| 2,116,573 | 10/1972 | Fed. Rep. of Germany | 179/121 D |
| 1,349,450 | 12/1963 | France | 179/121 D |
| 240,251 | 4/1946 | Switzerland | 179/110 A |

*Primary Examiner*—George G. Stellar

*Attorney, Agent, or Firm*—Robert E. Burns; Emmanuel J. Lobato; Bruce L. Adams

[57] ABSTRACT

A microphone comprises a pair of electroacoustic transducing high polymer piezoelectric semi cylindrical shaped membranes having a single axis of elongation tangent to the curvature mounted in a housing facing each other. The membranes are electrically series connected to each other with a connection between the facing surfaces thereof and are of prescribed polarizations to generate an output which is substantially twice the voltage developed individually from each membrane when said membranes are caused to flex in opposite directions and substantially zero when said membranes are caused to flex in the same direction.

6 Claims, 11 Drawing Figures

MICROPHONE CAPABLE OF CANCELLING MECHANICAL GENERATED NOISE

FIELD OF THE INVENTION

The present invention relates to electroacoustic transducers and in particular to a microphone which is capable of cancelling mechanically generated noise and delivers an increased output in response to acoustic waves.

SUMMARY OF THE INVENTION

An object of the invention is to provide a noise-cancelling microphone which is immune to noise generated from mechanical shocks applied to the microphone.

Another object of the invention is to provide a noise-cancelling microphone which is particularly suitable as a built-in microphone for portable tape recorders.

A further object of the invention is to provide a microphone which comprises a pair of electroacoustic transducing membranes mounted in opposed relation to form a pair of oppositely facing sound receiving surfaces to generate an increased output substantially double the individual output from each transducing membrane when sound pressure is applied in opposite directions to the sound receiving surfaces.

BRIEF DESCRIPTION OF THE DRAWINGS

These and other objects, features and advantages of the invention will become understood from the following description when read in conjunction with the accompanying drawings, in which.

DESCRIPTION OF THE PREFERRED EMBODIMENTS

Figure 1:
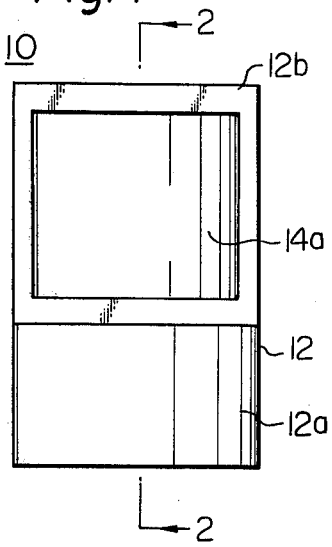
FIG. 1 is front view of a noise-cancelling microphone embodying the invention.
Figure 2:
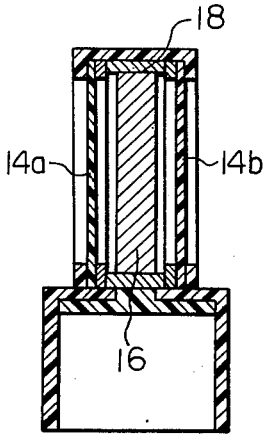
FIG. 2 is a cross-sectional view taken along the lines 2—2 of FIG. 1.

In FIG. 1 is illustrated a microphone 10 embodying the present invention which comprises a housing 12 with a cylindrical base portion **12*a* and an apertured frame portion 12*b*. In the frame portion 12*b* of the housing is mounted a pair of identical framed piezoelectric membrane units 14*a* and 14*b*. As clearly shown in FIG. 2, the framed piezoelectric membrane units 14*a* and 14*b* are mounted in parallel on the opposite sides of the frame structure 12*b* so that they are exposed to acoustic waves applied thereto in opposite directions. Between the membrane units is disposed an acoustic damping material or absorber 16 which is secured in a metal frame 18**.

Figure 3:
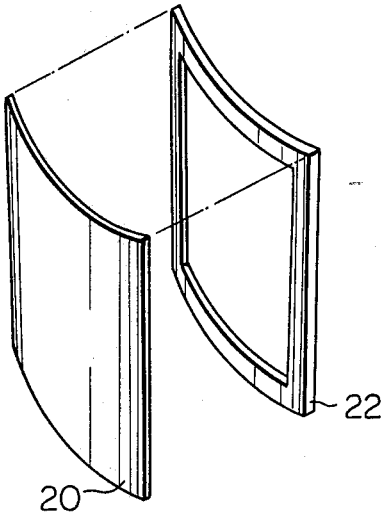
FIG. 3 is an exploded view of a framed electroacoustic transducing membrane mounted in the microphone of FIG. 1.

As shown in FIG. 3, each of the piezoelectric membrane units comprises a high-polymer piezoelectric membrane 20 and a rectangular apertured metal frame structure 22 which are adhesively secured together by a suitable cementing agent. The piezoelectric membrane 20 is prepared by elongating a film of piezoelectric material such as polyfluoride vinylidene about three times its original length until a thickness of from 5.5 to 30 micrometers is reached. A metal coating is then deposited on each side of the piezoelectric film by evaporating the metal in a vacuum chamber to serve as electrodes. The metal coated piezoelectric film is then polarized in the direction of its thickness by setting up an electric field of about 1000 kilobolts per centimeter to impart a piezoelectric constant of from $20 \times 10^{-12}$ to $30 \times 10^{-12}$ Coulombs per Newton.

Figure 4:
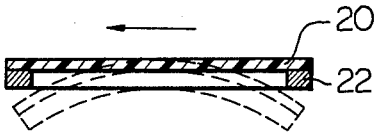
FIG. 4 is a cross-sectional view of the framed membrane of FIG. 3 when secured together with the arrow indicating the direction of elongation which coincides with the direction of circumference of the membrane.
Figure 5A:
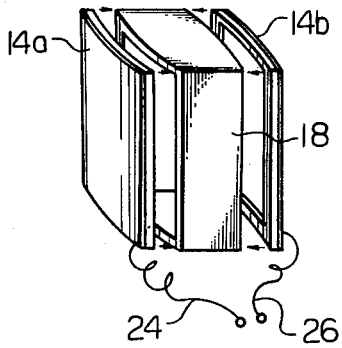
FIG. 5A illustrates the mechanical and electrical connection of two framed membranes in the housing of FIG. 1.
Figure 5B:
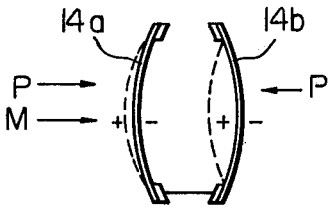
FIG. 5B is a schematic illustration useful for describing the operation of FIG. 5A.

The framed membrane unit 14 is then bent to take the shape of an arch as shown in FIG. 4 when it is mounted in the housing 12 so that the membrane 20 is mechanically stressed in the direction of elongation as indicated by the arrow in the Figure. As illustrated in Fig. 5A, the inner side metal coatings of both membranes 20 are connected electrically by the inner frame structure 18 and their outer side coatings are connected to output leads 24 and 26 so that both membranes are connected in series across the output leads. The direction of polarization of both membranes is such as to generate an output which is double the amplitude of the signal generated individually In the illustrated embodiment, both membranes are arched outwardly in opposition to each other and the membrane unit **14*a*** is positive on its outer side while the other membrane is positive on its inner side as shown in FIG. 5B. Assume that sound pressure is exerted in opposite directions as indicated by the arrows P, both membranes will be caused to flex inwardly and produce electrical signals of such polarities which coincide with the signs indicated in FIG. 5B. Therefore, the generated signals will add up together to provide an output twice the voltage which would be individually generated from each membrane.

If a mechanical impact as indicated by the arrow M is applied to the housing 12, both membranes will be caused to flex in the same direction is indicated by broken lines because their tendency to remain stationary. The resulting electrical signals will have polarities which are opposed to each other and thus cancelled out. Therefore, the microphone of the present invention is free of noise caused by mechanical shocks.

Figure 6A:
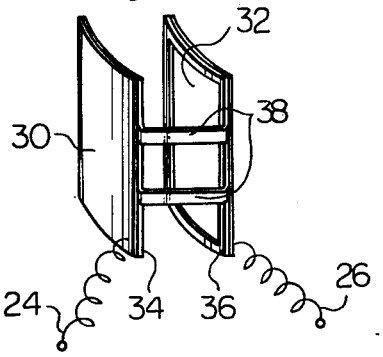
FIG. 6A is a modification of FIG. 5A.
Figure 6B:
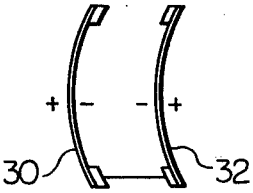
FIG. 6B is a schematic illustration useful for describing the operation of FIG. 6A.

FIG. 6A illustrates a modification of FIG. 5A which is preferable in terms of mass production. Identical piezoelectric membranes 30 and 32 are adhesively secured to metal frames 34 and 36 respectively which are integrally connected together by members 38. Both membranes are arched in the same direction as clearly shown in FIG. 6B. In this modification the direction of polarization is opposite to each other so that in this example the outer side of both membranes are poled positive with respect to the inner side. Upon inward flexure of both membranes in response to an acoustic impulse, the voltage developed across membrane 30 has polarities just as indicated in FIG. 6B while the voltage across the membrane 32 has polarities opposite to those shown in FIG. 6B.

Figure 7B:
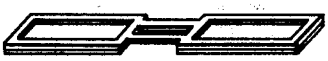
FIGS. 7A to 7C illustrate a series of processes with which the electroacoustic transducing membranes of FIG. 6A are fabricated.
Figure 7A:
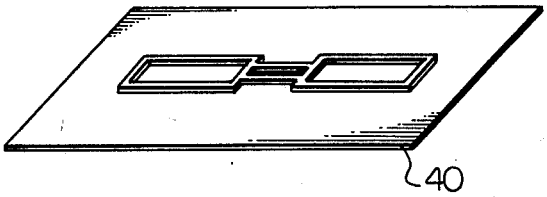
Figure 7C:
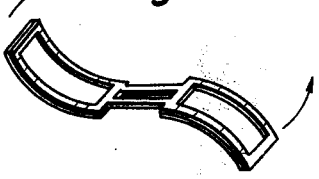

The microphone of FIG. 6A can be fabricated in a series of processes as depicted in FIGS. 7A to 7C. Since the outer sides of the membranes 30 and 32 are poled at the same polarity, the frames 34 and 36 can be adhesively secured to one side of a polarized piezoelectric film 40 as shown in FIG. 7A. The film is then cut along the edges of the frames (FIG. 7B) to form a pair of cylindrical surfaces and bent at right angles at the junctions between the frames and connecting members 38 in the directions as indicated by the arrows in FIG. 7C.

What is claimed is:

1. A noise-cancelling electroacoustic transducer comprising:

a pair of first and second high-polymer piezoelectric membranes each having electrically conductive, oppositely polarized surfaces and a single axis of elongation parallel to said surfaces; and an electrically conductive support structure having an opening therethrough including opposed first side portions and opposed second side portions, each of the first side portions including opposed first and second curved perimetrical edges in the direction of the axis of said opening and each of said second side portions including straight perimentrical first and second parallel edges, said first and second membranes being held respectively in a part-cylindrical shape in spaced relation by the curvature of said first and second perimentrical edges of said first side portions and the straight perimetrical edges of said second side portions which the circumference of the part-cylindrical shape being parallel to said axis of elongation, the direction of curvature of said first and second perimetrical edges of said first side portions and the direction of polarization of said membranes being such that output voltages produced from the outer faces of said membranes in response to an impulse reinforce each other when they are flexed in opposite directions and cancel out each other when they are flexed in a same direction.

2. An electroacoustic transducer comprising:

a housing having a pair of opposed first and second apertures;

a spectacles-like structure having first and second conductive frames capable of taking the shape of an arch in said housing adjacent to said first and second apertures, respectively;

first and second high-polymer piezoelectric membranes each of which has been prepared by elongation in one direction and polarized in the direction of its thickness and coated with a conductive film on its opposite surfaces, said first and second membranes being adhesively secured to said first and second frame structures, respectively, to take the shape of an arch in a same direction with the direction of polarization being opposite to each other; and the direction of arches and polarization of said membranes being such that when both membranes are caused to flex in opposite directions there developes an output which is substantially twice the amplitude of the signal developed from each membranes, and there develops substantially no output when said membranes are caused to flex in the same direction.

3. An electroacoustic transducer as claimed in claim 2, wherein said first and second membranes are arched in opposite directions and polarized in the same direction.

4. An electroacoustic transducer as claimed in claim 3, wherein said electrical connecting means comprises an open-ended conductive casing and said first and second membranes being in contact with the end of said conductive casing.

5. A noise-cancelling electroacoustic transducer comprising:

a housing having an opening therethrough including opposed first side portions and opposed second side portions, each of the first side portions including opposed first and second curved perimetrical edges in the direction of the axis of said opening and each of said second side portions including straight parallel perimetrical edges;

a pair of first and second high-polymer piezoelectric membranes each having electrically conductive, oppositely polarized surfaces and a single axis of elongation parallel to said surfaces, said first and second membranes being respectively held in a part-cylindrical shape in spaced relation by the curvature of said first and second perimetrical edges of said first side portions and the straight edges of said second side portions with the circumference of the part-cylindrical shape being parallel to said axis of elongation; and means for electrically interconnecting the inner faces of said membranes so that electrical signals may be produced in response to an impulse from the outer faces of said membranes, the direction of curvature of said first and second perimetrical edges of said first side portions and the direction of polarization of said membranes being such that said electrical signals reinforce each other when they are flexed in opposite directions and cancel out each other when they are flexed in a same direction.

6. The electroacoustic transducer as claimed in claim 5, further comprising an acoustic absorber disposed in said housing.

* * * * *